US010301749B2

(12) United States Patent
Vetterli et al.

(10) Patent No.: US 10,301,749 B2
(45) Date of Patent: May 28, 2019

(54) FASTENING DEVICE FOR COMB ELEMENTS ON A CIRCULAR COMB

(71) Applicant: Graf + Cie AG, Rapperswil (CH)

(72) Inventors: Arnold Vetterli, Dübendorf (CH); Markus Schilter, Feusisberg (CH); Urs Müller, Euthal (CH); Urs Schiltknecht, Stäfa (CH)

(73) Assignee: Graf + Cie AG, Rapperswil (CH)

( * ) Notice: Subject to any disclaimer, the term of this patent is extended or adjusted under 35 U.S.C. 154(b) by 114 days.

(21) Appl. No.: 15/261,903

(22) Filed: Sep. 10, 2016

(65) Prior Publication Data

US 2017/0073847 A1 Mar. 16, 2017

(30) Foreign Application Priority Data

Sep. 11, 2015 (CH) ..... 1317/15

(51) Int. Cl.

| | |
|---|---|
| ***D01G 19/10*** | (2006.01) |
| ***D01G 15/88*** | (2006.01) |
| ***D01G 15/92*** | (2006.01) |

(52) U.S. Cl.

CPC ..... *D01G 19/105* (2013.01); *D01G 15/88* (2013.01); *D01G 15/92* (2013.01)

(58) Field of Classification Search

CPC ..... D01G 15/92; D01G 19/105

See application file for complete search history.

(56) References Cited

U.S. PATENT DOCUMENTS 4,414,710 A * 11/1983 Bolen ..... D01G 15/40 19/105
4,716,629 A * 1/1988 Iwata ..... D01G 19/105 19/114
4,947,520 A * 8/1990 Hollingsworth ..... D01G 15/20 19/105
5,016,321 A * 5/1991 Hollingsworth ..... B65H 54/80 19/105

(Continued)

FOREIGN PATENT DOCUMENTS

BE 385519 A 11/1932
CH 706 344 A2 10/2013

(Continued)

OTHER PUBLICATIONS

Swiss Search Report, dated Oct. 29, 2015.
EP Search Report, dated Jan. 19, 2017.

*Primary Examiner* — Shaun R Hurley
(74) *Attorney, Agent, or Firm* — Dority & Manning, P.A.

(57) ABSTRACT

A circular comb of a combing machine has a base body oriented parallel to a rotational axis of the circular comb, the base body including an inner support surface and a radially oriented opening. A comb element is disposed on an outer circumference of the base body, and a retaining element having a threaded bore is connected to the comb element. A threaded bolt has a threaded first section that engages into the threaded bore, a middle section that protrudes through the radially oriented opening the in base body, and a second end section supported on the inner support surface of the base body. A diameter of the first end section of the threaded bolt is smaller than a diameter of the middle section. A spring element is provided between the inner support surface of the base body and the second end section of the threaded bolt.

8 Claims, 2 Drawing Sheets

(56) References Cited

U.S. PATENT DOCUMENTS

| | | | | |
|---|---|---|---|---|
| 5,038,440 | A | 8/1991 | Demuth et al. | |
| 5,113,559 | A * | 5/1992 | LaRoche | D01H 4/32 19/112 |
| 6,047,621 | A * | 4/2000 | Dries | B21D 28/34 83/136 |
| 6,077,011 | A * | 6/2000 | Walker | F16B 21/165 24/453 |
| 6,101,805 | A * | 8/2000 | Wassenhoven | C04B 35/565 19/112 |
| 9,145,626 | B2 | 9/2015 | Müller | |
| 2012/0102714 | A1* | 5/2012 | Scheinberger | F16B 19/1063 29/509 |
| 2013/0263408 | A1* | 10/2013 | Muller | D01G 19/105 19/234 |
| 2015/0167203 | A1* | 6/2015 | Shimbara | D01G 19/105 19/233 |
| 2017/0073848 | A1* | 3/2017 | Vetterli | D01G 19/105 |

FOREIGN PATENT DOCUMENTS

| | | | |
|---|---|---|---|
| CN | 2069418 | U | 1/1991 |
| DE | 55232 | C | 1/1891 |
| DE | 33 36 876 | A1 | 4/1985 |
| EP | 0 395 909 | A1 | 11/1990 |
| EP | 0 839 934 | A1 | 5/1998 |
| EP | 2 650 414 | A1 | 10/2013 |
| EP | 2 883 984 | A1 | 6/2015 |
| JP | S54158018 | U | 11/1979 |

* cited by examiner

FASTENING DEVICE FOR COMB ELEMENTS ON A CIRCULAR COMB

BACKGROUND OF THE INVENTION

The invention relates to a circular comb of a combing machine, comprising a base body that is situated in parallel to its rotation axis and that has at least one comb element resting on its outer circumference (circumferential surface), and at least one retaining element that is connected to the comb element and has at least one threaded bore into which, in each case a first end section of a threaded bolt provided with a thread protrudes. The threaded bolt has a middle section that protrudes through a radially oriented opening in the base body, and the threaded bolt is provided with a second end section by which it is supported on an inner support surface of the base body in the area of the particular opening, the cross-sectional area of the second end section extending, at least partially, beyond the cross-sectional area of the particular opening.

BACKGROUND

A design is known from DE 33 36 876 A1 in which the comb elements for a circular comb are made up of multiple toothed segments which are provided with a toothed clothing and held together by longitudinal bolts. The longitudinal bolts protrude into boreholes provided in the toothed segments. Multiple comb elements arranged one behind the other (also referred to as a bar) form a comb segment having a closed combing surface. The toothed segments of the particular comb element are provided with a dovetail-shaped recess via which they are connected to a base body of the circular comb by means of a retaining member. The retaining member is provided with a corresponding dovetail-shaped counterprofile, via which it engages with the recess in the toothed segments and is held in a corresponding recess in the base body via a screw connection.

A similar design is known from published CH 706 344 A2, in which toothed clothings are fastened to a retaining rod that is connected to a base body via dovetail-shaped fastening means. Here as well, a screw connection is provided via which the fastening means is connected to the base body. In practice, maximum torques are specified for tightening the screws, via which the retaining members, i.e., the retaining rods for fastening the comb elements to the base body, are connected or braced. The aim of specifying a maximum torque is to prevent the comb elements from warping when they are braced against the outer circumferential surface of the base body during the fastening operation. These specifications may also be met by using a torque wrench, so that no warping occurs in the comb elements, which could result in dimensional deviation and influence the distance of the tooth tips of the comb clothings from the lower nipper plate of a nipper unit. In practice, however, it has been shown that in many cases a torque wrench is not used, and these screws are tightened with a simple wrench, resulting in the above-described risk of tightening the screws with a higher torque than specified. This may result in the described deformations of the comb clothings, which may adversely affect a distance to be maintained between the lower nipper plate and the tooth tips. In the worst case, this may result in collisions between the tooth tips of the clothings and the lower nipper plate.

SUMMARY OF THE INVENTION

An object of the invention, therefore, is to propose a device with which the described disadvantages of known designs are avoided, and overtightening of the threaded bolts during fastening of the comb elements to the base body of the circular comb is precluded. Additional objects and advantages of the invention will be set forth in part in the following description, or may be obvious from the description, or may be learned through practice of the invention.

The objects are achieved in that it is proposed that the diameter of the first end section of the particular threaded bolt is smaller than the diameter of the middle section, and a spring element is provided between the inner support surface of the base body and the second end section of the threaded bolt.

The proposed difference in diameters of the middle section and of the first end section of the particular threaded bolt ensures that the first end section of the threaded bolt, which is provided with a thread, can be screwed into a threaded bore of the retaining element only until the threaded bolt rests, with the shoulder that is present between the first end section and the middle section, on the retaining element. At the same time, when the threaded bolt is screwed into the retaining part, the spring is tensioned between an inner support surface of the base body and the second end section of the threaded bolt, thereby bracing the comb element against the outer circumference of the base body (or the circumferential surface thereof) by means of the retaining element via the elastic force of the spring. That is, the fastening or the contact force of the particular comb element on the base body no longer takes place due to the magnitude of the tightening torque on the particular threaded bolt, but, rather, due to the elastic force of the spring element.

The particular threaded bolt is preferably dimensioned in such a way that the spring element is tensioned in the installed position of the particular comb element, and the end of the middle section of the threaded bolt opposite from the first end section rests on the retaining element in the area of the threaded bore.

Multiple comb elements are generally mounted one behind the other on the base body, viewed in the circumferential direction of the circular comb, with the tooth density increasing opposite the direction of rotation of the circular comb. Viewed in the direction of the rotation axis of the circular comb, i.e., over the length of the particular comb element, at least two threaded bolts are provided for fastening the comb element to the base body.

It is preferably provided that the particular retaining element is detachably connected to the comb element. When a comb element is replaced, it is thus possible to reuse the previously used retaining elements for the newly inserted comb element.

It is also conceivable to use a retaining element that extends over the entire length of the particular comb element, and which is connected to the comb element via additional fastening means.

To be able to position the comb segment in relation to the base body during installation, and to fix same in the installed position, it is further proposed that the base body has radially outwardly directed recesses into which the particular retaining element protrudes.

It is further proposed that the base body, viewed in the circumferential direction of the circular comb, is provided with support ribs, situated at a distance from one another, on which the end areas of the particular comb elements rest, the support ribs extending in parallel to the rotation axis of the circular comb. Secure seating of the particular comb element on the outer circumference of the base body in the area of the support ribs is ensured in this way.

The spring elements are preferably designed as coil springs or as wave springs. The spring element may thus have a small, compact design, the elastic force generated being sufficient to securely hold the comb element on the outer circumference of the base body.

Furthermore, a combing machine having at least one circular comb designed according to the invention is claimed.

BRIEF DESCRIPTION OF THE DRAWINGS

Further advantages of the invention are shown and described with respect to the following exemplary embodiments.

DETAILED DESCRIPTION

Figure 1:
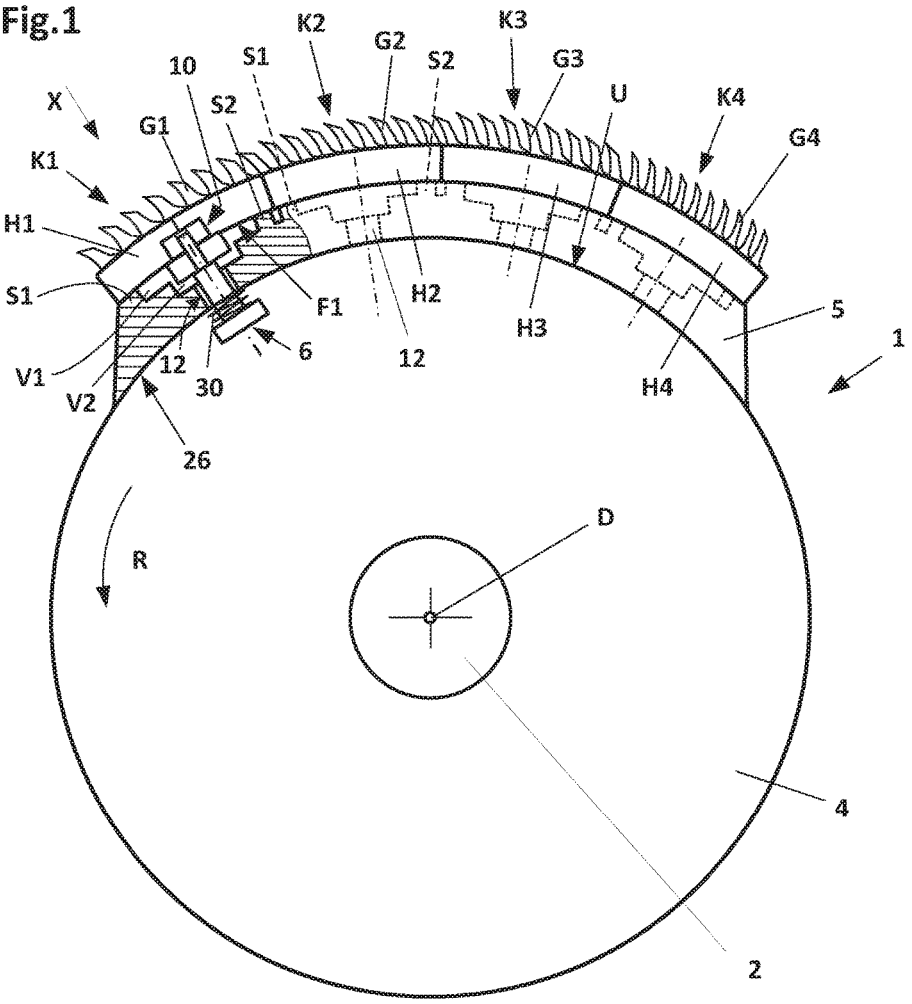
FIG. 1 shows a schematic side view of a circular comb of a combing machine, with fastening, designed according to the invention, of a comb element.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a circular comb 1, having a circular comb shaft 2 on which two flanges 4 are mounted at a distance from one another in a rotatably fixed manner. This is also particularly apparent from the partial view X according to FIG. 1, shown in FIG. 2. A base body 5 is fastened to a partial circumference of the flange 4, and on its circumferential surface U the base body bears multiple comb elements K1 to K4 situated one behind the other. In the present example, the comb elements K1-K4 have a retaining rod H1-H4 to which clothing elements G1-G4 are respectively fastened. The clothing elements G1-G4 may be fastened to the respective retaining rods H1-H4 via a laser-welded seam, for example, as shown and described in published EP 2650414 A1. However, other types of fastenings are also possible.

Figure 2:
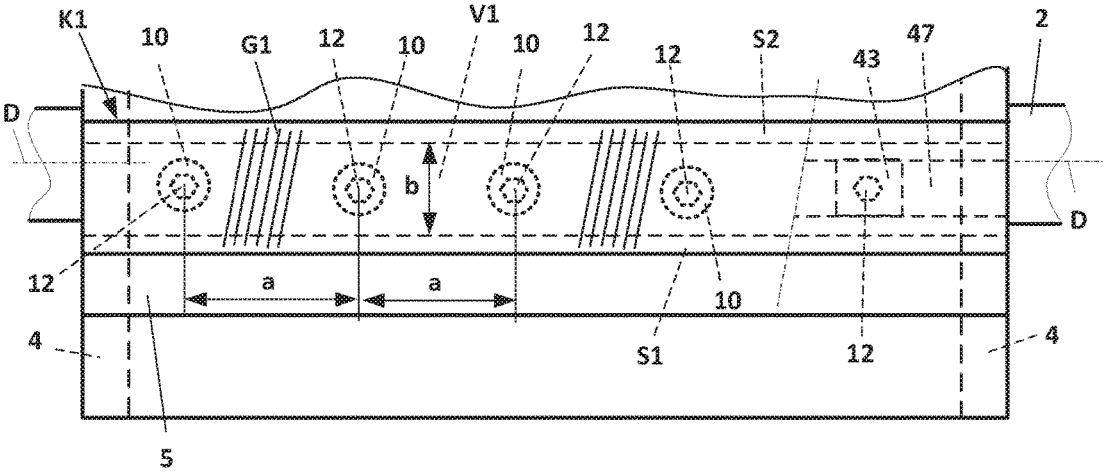
FIG. 2 shows a top view X according to FIG. 1.
Figure 3:
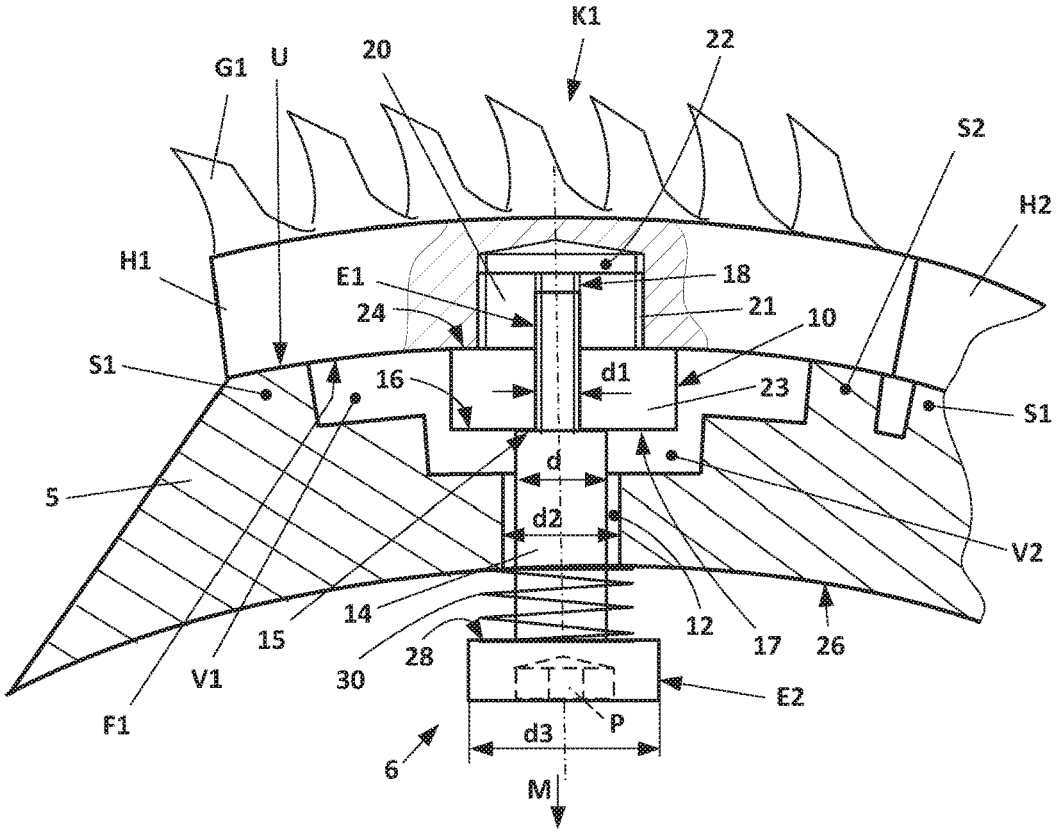
FIG. 3 shows an enlarged partial view, according to FIG. 1, of one exemplary embodiment.

One exemplary embodiment according to the invention of the fastening of the front comb element K1 is shown in FIG. 1, and in an enlarged partial view in FIG. 3. The other comb elements K2 to K4 may be connected to the base body 5 in the same way, as indicated by dashed lines in FIG. 1. In the support area of the comb elements K1-K4, the base body 5 is provided in each case with a first depression V1 which extends along the rotation axis D of the circular comb shaft 2. This depression V1 is formed by two support ribs S1, S2 which are situated at a distance b from one another and which extend in a longitudinal direction L of the comb elements K1-K4, i.e., in parallel to the rotation axis D, as is also apparent from the top view X (according to FIG. 1) in FIG. 2. The retaining rod H1 with its base area F1 is supported on these support ribs in the installed position. Further circular depressions V2, which are situated at a distance a from one another and into which retaining elements 10 at least partially protrude, are provided in the area of the first depression V1. A circular through opening 12 having a diameter d2 opens into the particular depression V2. A middle section 14 of a threaded bolt 6 which has a first end section E1 provided with a thread protrudes through the particular through opening 12. The middle section 14 has a diameter d that is larger than the diameter d1 of the first end section E1 of the threaded bolt. This results in a shoulder 15 between the middle section 14 and the first end section E1 of the threaded bolt 6. The middle area of the threaded bolt, with the end face 16 of the middle area 14 which extends beyond the diameter d1 in the area of the shoulder 15, comes to rest on a lower surface 17 of the retaining element 10 when the first end section E1 of the threaded bolt 6 is completely screwed into a threaded bore 18 of the particular retaining element (see FIG. 3). In the example shown in FIG. 3, the retaining element 10, of which a plurality are situated at a distance a from one another in the longitudinal direction L of the comb element K1, has a step-shaped design, and has a first cylindrical section 20 provided with a thread 21. The second section 23 of the retaining element 10 extends over the diameter of the first section 20, and has a lower surface 17 on which the end face 16 of the middle area of the threaded bolt 6 comes to rest in the installed position shown. The section 20 of the retaining element 10 is screwed into a threaded bore 22 of the retaining rod H1 via the thread 21 and fastened. In the screwed-in state of section 20 of the retaining element 10 (FIG. 3), an upper surface 24 of the second section 23 of the retaining element 10 which extends beyond the first section 20 comes to rest on the base area F1 of the retaining rod H1 and is fixed in this position.

The threaded bolt 6 has a second end section E2 which is situated opposite from the end section E1 and adjoins the middle section 14. The end section E2 has, at least in part, an external dimension, i.e., a diameter d3, that is larger than the diameter d2 of the through opening 12 through which the middle section 14 of the threaded bolt protrudes. On the middle section 14 of the threaded bolt 6, a compression spring in the form of a coil spring 30 is mounted between an inner support surface 26 of the base body 5 and a support surface 28 of the second end section E2. Instead of the coil spring 30, a wave spring 31, as shown in the example in FIG. 4, may be used.

The outer diameter of the particular spring element 30 or 31 is selected in such a way that the spring element extends beyond the through bore 12 and comes to rest on the inner support surface 26 of the base body. During installation of the particular comb element K1 (K2, K3, K4), a force M is generated via the particular spring element 30 (31) which braces the retaining rod H1 (H2-H4) of the particular comb element K1 (K2-K4) with its support surface F1 against the circumferential surface U of the base body, which comes to rest on the ribs S1, S2.

Figure 4:
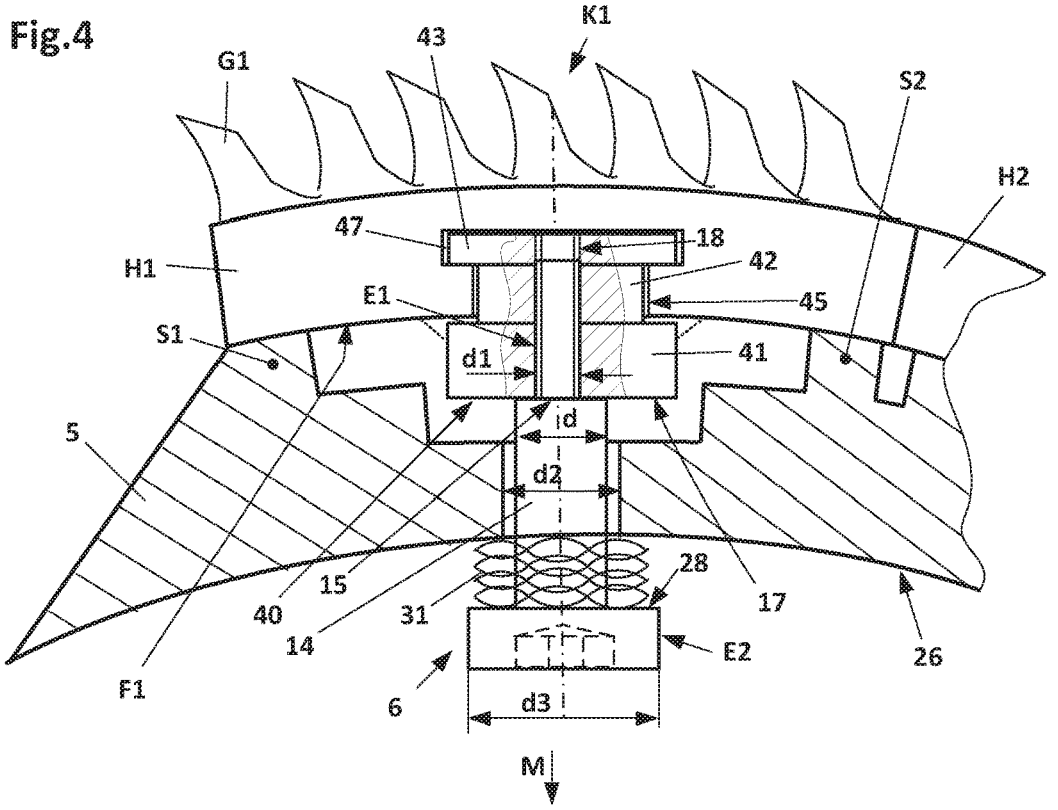
FIG. 4 shows an enlarged partial view, according to FIG. 1, of another exemplary embodiment.

The exemplary embodiment according to FIG. 4 differs from the exemplary embodiment according to FIG. 3, in that a different type of fastening, i.e., a different design of the retaining element 40, is provided. The particular retaining element 40 has a first section 41 (cylindrical, for example) which protrudes into the depressions V1 and V2 in the base body 5. The first section is adjoined by a further section 42 (cylindrical or square) which protrudes into a longitudinal slot 45 extending in the longitudinal direction L of the retaining rod H1. The end section 43 of the retaining element 40 adjoining the section 42 may have a square or rectangular cross-sectional shape, for example, as indicated on the right side in the illustration in FIG. 2, for example. The end section 43, which extends beyond the section 42, is inserted into a longitudinal slot 47 in the retaining rod H1 and positioned corresponding to the through opening in the base body.

The retaining element 40, the same as for the retaining element 10, is provided with a threaded bore 18, into which the end section E1 of the threaded bolt 6 is screwed. A wave spring 31 is used as the spring element in the exemplary embodiment in FIG. 4. The other components correspond to the exemplary embodiment in FIG. 3, and therefore are not described here in greater detail.

As is apparent from the view X (according to FIG. 1) in FIG. 2, multiple threaded bolts 8 for fastening the comb element are inserted in the longitudinal direction L of the particular comb element K1 (K2-K4). The other comb elements K2-K4 are also fastened to the base body 5 in the manner described, the particular retaining rods H2-H4 likewise resting on support ribs S1, S2 which are mounted on the circumferential surface U of the base body, as indicated by dashed lines in FIG. 1.

According to the exemplary embodiment in FIG. 3, when the comb element K1 is installed on the base body 5, the provided number of retaining elements 10 are screwed into the particular threaded bore 22 of the retaining rod 10 via the section 20 provided with a thread 21, until the upper surface 24 of the section 23 comes to rest on the base area F1 of the retaining rod H1. The preassembled comb element K1 is subsequently positioned on the base body 5 in such a way that the particular sections 23 of the retaining rod 10 protrude into the depressions V1 and V2, and the threaded bores 18 are situated opposite from the through openings 12 in the base body 5. Threaded bolts 6 are then passed in succession through the through openings 12 from the underside of the base body 5 in the area of its inner support surface 26, and with their first threaded end sections E1 are screwed into the threaded bore 18 in the retaining element 10 until the end face 16 of the middle section 14 rests on the lower surface 17 of the retaining element 10. Before the threaded bolt 6 is inserted into the through opening 12, a spring element 30 (31) is mounted on the middle section 14 and brought into contact with the support surface 28 of the second end section E2. This end section E2 may be designed as a screw head, or, as schematically indicated, may be provided with a hexagon socket P via which the threaded bolt may be turned.

The spring element 30 is compressed and tensioned when the first end section E1 is screwed into the retaining element 10. Since the spring element 30 (31) is supported on the inner support surface 26, the elastic force which results from the tensioning of the spring element 30 generates a force M which pushes the second end section E2 of the threaded bolt 6 away from the inner support surface of the base body 5. As a result, the comb element, which is connected to the threaded bolt via the retaining element 10, with its base area F1 is pressed or braced against the circumferential surface U of the base body 5 in the area of the support ribs S1, S2.

Overtightening of the particular threaded bolt is thus precluded, since the threaded bolt with its shoulder 15 rests against an end stop on the surface 17 of the retaining element. That is, the comb element is braced against the outer circumference U of the base body and fixed in this position solely via the resulting elastic force of the spring element 30 (31). Due to the specified geometric relationships of the threaded bolt and the retaining element, a uniform, constant contact force is ensured at all fastening locations. The tightening torque of the threaded bolts no longer has an influence on the contact force with which the particular comb element is braced or pressed against the circumferential surface U of the base body 5.

During the installation of the exemplary embodiment shown in FIG. 4, the retaining element 40 shown there is not screwed into the retaining rod H1, but instead is laterally inserted via its end section 43 into a longitudinal slot 47 in the retaining rod, as also partially illustrated on the right side of FIG. 2. When the comb element K1 is mounted, the inserted retaining elements are then positioned in such a way that their threaded bore 18 is situated opposite from the particular through opening 12 in the base body. It is also conceivable to provide markings in the region of the base area F1 of the retaining rod H1, by means of which the retaining elements 40 may be brought into the correct position during insertion into the longitudinal slot 47.

The other installation steps for fastening the comb element K1 correspond to those which have already been described for the exemplary embodiment in FIG. 3. The other comb elements K2-K4 shown in FIG. 1 are fastened to the base body 5 in the same way as described for the comb element K1.

As indicated by dashed lines in FIG. 4, the particular retaining element 40 could also be connected to the retaining rod H1 via a weld seam. It is also conceivable to join the retaining element to the retaining rod via an adhesive bond. Another option would be to mold a retaining element in one piece onto the retaining rod. In these cases, the particular retaining element is fixedly and undetachably connected to the retaining element.

The proposed type of fastening of the comb elements to a base support of a circular comb allows simple, quick installation and deinstallation of the comb elements, whereby the tightening torque on the threaded bolts used has no influence on the contact force of the particular comb element on the outer circumference U of the base body.

Modifications and variations can be made to the embodiments illustrated or described herein without departing from the scope and spirit of the invention as set forth in the appended claims.

The invention claimed is:

1. A circular comb of a combing machine, comprising:

a base body oriented parallel to a rotational axis of the circular comb, the base body comprising an inner support surface and a radially oriented opening;

at least one comb element disposed on an outer circumference of the base body;

a retaining element connected to the comb element, the retaining element comprising a threaded bore;

a threaded bolt, the threaded bolt comprising a threaded first end section that engages into the threaded bore of the retaining element, a middle section that protrudes through the radially oriented opening the in base body, and a second end section supported on the inner support surface of the base body at the radially oriented opening, the second end section comprising a cross-sectional area that extends beyond a cross-sectional area of the radially oriented opening;

a diameter of the first end section of the threaded bolt is smaller than a diameter of the middle section; and a spring element provided between the inner support surface of the base body and the second end section of the threaded bolt.

2. The circular comb according to claim 1, wherein the spring element is tensioned in an installed position of the comb element on the base body, and an end of the middle section of the threaded bolt opposite from the first end section rests on the retaining element at the threaded bore.

3. The circular comb according to claim 1, wherein the retaining element is detachably connected to the comb element.

4. The circular comb according to claim 1, wherein the base body comprises a radially outwardly directed recess into which the retaining element protrudes.

5. The circular comb according to claim 1, wherein the base body comprises circumferentially extending and spaced-apart support ribs on which ends of the comb elements rest, the support ribs extending parallel to the rotational axis of the circular comb.

6. The circular comb according to claim 1, wherein the spring element comprises a coil spring.

7. The circular comb according to claim 1, wherein the spring element comprises a wave spring.

8. A combing machine, comprising the circular comb according to claim 1.

* * * * *